US008381481B2

(12) United States Patent
Lenhardt

(10) Patent No.: US 8,381,481 B2
(45) Date of Patent: Feb. 26, 2013

(54) LINEAR CONNECTOR FOR SPACERS IN INSULATING GLASS PANES, METHOD FOR THE PRODUCTION THEREOF AND METHOD FOR CONNECTING TWO ENDS OF A HOLLOW PROFILE BAR FOR A SPACER USING SUCH A LINEAR CONNECTOR

(75) Inventor: Karl Lenhardt, Liebenzell (DE)

(73) Assignee: Plus Inventia AG, St. Gallen (CH)

( * ) Notice: Subject to any disclaimer, the term of this patent is extended or adjusted under 35 U.S.C. 154(b) by 0 days.

(21) Appl. No.: 13/054,289

(22) PCT Filed: Jul. 11, 2009

(86) PCT No.: PCT/EP2009/005056

§ 371 (c)(1),
(2), (4) Date: Feb. 23, 2011

(87) PCT Pub. No.: WO2010/006745

PCT Pub. Date: Jan. 21, 2010

(65) Prior Publication Data

US 2011/0175295 A1 Jul. 21, 2011

(30) Foreign Application Priority Data

Jul. 16, 2008 (DE) ..... 10 2008 034 025
Jun. 2, 2009 (DE) ..... 10 2009 024 808

(51) Int. Cl.
*E04C 2/38* (2006.01)

(52) U.S. Cl. ..... 52/656.9; 52/655.1; 52/848; 403/294; 403/298

(58) Field of Classification Search ..... 52/656.9, 52/655.1, 84, 848; 403/292, 294, 295, 298
See application file for complete search history.

(56) References Cited

U.S. PATENT DOCUMENTS

| | | | | |
|---|---|---|---|---|
| 4,299,508 | A * | 11/1981 | Kerscher et al. | 403/172 |
| 4,512,699 | A * | 4/1985 | Jackson et al. | 411/368 |
| 4,683,634 | A * | 8/1987 | Cole | 29/412 |
| 5,120,175 | A * | 6/1992 | Arbegast et al. | 411/501 |
| 6,431,784 | B1 * | 8/2002 | Kronenberg | 403/297 |
| 6,764,247 | B1 * | 7/2004 | Kronenberg | 403/292 |
| 7,070,356 | B2 | 7/2006 | Kronenberg et al. | |
| 7,757,455 | B2 | 7/2010 | Gallagher | |
| 2002/0102127 | A1 * | 8/2002 | Loh | 403/292 |
| 2003/0059253 | A1 * | 3/2003 | Trpkovski et al. | 403/294 |
| 2003/0202844 | A1 * | 10/2003 | Bayer | 403/286 |
| 2007/0022700 | A1 * | 2/2007 | Gallagher | 52/656.9 |
| 2008/0236096 | A1 | 10/2008 | Lenhardt | |

FOREIGN PATENT DOCUMENTS

| | | | |
|---|---|---|---|
| DE | 201 16 365 | U1 | 3/2003 |
| EP | 2 045 433 | A1 | 10/2007 |

* cited by examiner

*Primary Examiner* — Brian Glessner
*Assistant Examiner* — Brian D Mattei
(74) *Attorney, Agent, or Firm* — Walter A. Hackler; Marc G. Martino

(57) ABSTRACT

What is described is a linear connector for connecting two opposing ends of a hollow profile member for the purposes of forming a frame-like spacer for the production of insulating glass panes. The linear connector includes a top side, a bottom side and two side surfaces, connecting the top side and the bottom side of the linear connector. The linear connector is provided with a midsection in a middle area of the linear connector, with the midsection extending at least along an entire width of the top side or of the bottom side of the linear connector.

15 Claims, 16 Drawing Sheets

LINEAR CONNECTOR FOR SPACERS IN INSULATING GLASS PANES, METHOD FOR THE PRODUCTION THEREOF AND METHOD FOR CONNECTING TWO ENDS OF A HOLLOW PROFILE BAR FOR A SPACER USING SUCH A LINEAR CONNECTOR

It is known to bend spacers for insulating glass panes from a hollow profile bar. After the bending operation, the two corners of the hollow profile bar are located opposite of each other and must be connected to each other to close the frame-shaped spacer. For this purpose, it is known to use straight connectors, the cross-sectional design of which is such that they fit without play in the clear cross-section of the hollow profile bar. Such straight connectors are referred to hereinafter as linear connectors. So as to facilitate the insertion into the hollow profile bar, the known linear connectors are preferably beveled at the ends. To ensure that they cannot be inserted more deeply into one end of the hollow profile bar than into the other end of the hollow profile bar, the known linear connectors comprise a rib or another protrusion at the center, which strikes against the edge of the hollow profile bar and thereby limits the insertion depth.

It is known to produce such linear connectors as plastic molded parts by way of injection molding. It is further known to produce such linear connectors by way of stamping and bending from sheet metal. They can be placed manually into the ends of the hollow profile bars. In manufacturing plants with higher degrees of automation, prefabricated connectors are inserted mechanically into the ends of the hollow profile bars.

From WO 20061092314 A1 linear connectors are known, which are produced by cutting them off extruded semifinished products. This has the advantage that linear connectors having different widths can be produced from one and the same semifinished product for spacers having different widths.

The inner chamber of an insulating glass pane must be kept dry to prevent moisture from depositing on the inside of the glass panes of the insulating glass pane at low temperatures. For this reason, insulating glass panes are sealed at the edges, so as to prevent moisture from diffusing in. Moisture present in the inner chamber of the insulating glass pane is absorbed by a desiccant, which is located in the hollow spacer of the insulating glass pane. So as to enable the desiccant to absorb the moisture from the inner chamber of the insulating glass pane, the side of the spacer facing the inner chamber of the insulating glass pane must be perforated.

As far as the sealing of the insulating glass pane is concerned, the joint between the two ends of a hollow profile bar to be connected by a linear connector is a critical point, because the otherwise sealed outside wall of the metallic spacer profile is interrupted here. The joint is typically sealed by filling the edge seam of the insulating glass pane, which is delimited by the outside of the spacer and by the edge sections of the two glass panes of the insulating glass pane glued to the spacer that protrude over the outside of the spacer, with a sealing compound. Good sealing compounds are expensive, and as the price of crude oil serving as the raw material for producing the sealing compound rises, so does the price of the compounds. Manufacturers of insulating glass therefore strive to use as little sealing compound as possible. For this purpose, it is already known not to apply the sealing compound continuously from one glass pane to the other glass pane all the way to the outside of the spacer, but to instead provide it only between the respective glass pane and a partial surface of the spacer facing the same. In this case, the sealing of the spacer at the location where it is closed by way of a linear connector requires special attention.

SUMMARY OF THE INVENTION

It is the object of the present invention to show a way by which, with little effort, good sealing can be achieved of spacer frames for insulating glass panes at a joint of the spacer frame.

This object is achieved by a linear connector having the features of claim 1. An inexpensive method for producing such a linear connector is disclosed herein. A method for connecting two mutually opposed ends of a hollow profile bar using such a linear connector is also disclosed herein. Advantageous refinements of the invention are the subject matter of the dependent claims.

In order to connect two mutually opposed ends of a hollow profile bar so as to form a frame-shaped spacer for producing insulating glass panes, the linear connector according to the invention comprises a top side, a bottom side, and two lateral surfaces, which connect the top side and bottom side of the linear connector to each other. In a central region of the linear connector, preferably precisely in the center of the linear connector, a waist is provided, which extends at least over the entire width of the top side or bottom side of the linear connector. This makes it possible to fill in the waist over the entire width of the top side or bottom side of the linear connector with a sealing compound. With this sealing compound, the seam between the two ends of the hollow profile bar can be sealed over the entire width. To this end, the linear connector is advantageously inserted into the mutually opposed ends of the hollow profile bar such that the waist is located at least opposite of the outside wall of the spacer. The outside wall of the spacer denotes the wall that delimits the insulating glass panes with the two glass panes glued to the spacer toward the outside. The wall located opposite of the outside wall of the spacer is referred to as the inside wall of the spacer because it faces the inner chamber of the insulating glass pane. The two walls of the spacer facing the glass panes are referred to as flanks. Corresponding terms are used here for the walls of a hollow profile bar of which the frame-shaped spacer is produced.

A seam in the outside wall of the spacer sealed from the inside is suited to completely seal the spacer at this location, more specifically even if the spacer contains a desiccant in the hollow space thereof, and the inside wall of the spacer is therefore perforated.

The linear connector is preferably produced from solid material at least in the region of the waist. This facilitates the configuration of a waist and lends the connector advantageous mechanical stability at this location for sealing the seam between the ends of the hollow profile rod.

The linear connector may overall be made of solid material, preferably of a plastic material. However, it may also be produced from a metal. Producing it from plastic material however is preferred, because this is less expensive and results in less heat transmission transversely through the spacer as compared to a metallic linear connector.

The linear connector does not necessarily have to be made of solid material on either side of the waist, but instead it may comprise hollow spaces, holes or fins, which preferably extend over the entire width of the linear connector and are directed toward the top side or bottom side of the linear connector, so that they act on the inside wall or on the outside wall of the hollow profile bar forming the spacer and provide resistance to the linear connector being pulled out of the ends of the hollow profile bar. Providing hollow spaces, holes or fins would save material and desirably worsen the heat transmission transversely through the spacer.

The waist preferably extends completely around the linear connector. This has the advantage that the entire seam between the two mutually opposing ends of the hollow profile bar can be sealed from the inside, this being along all peripheral walls of the spacer profile, along the outside wall, along the inside wall, and along the two flanks of the hollow profile bar.

The seam can be sealed from the inside by providing the waist with a sealing compound before the two ends of the hollow profile bar are completely pushed to together on the linear connector until they abut. By pressing in at least the outside walls of the two ends of the hollow profile bar, a close bond of the sealing compound with the inner surface of the hollow profile bar can be achieved, at least in the region of the particularly critical outside wall of the spacer.

However, another possibility is preferred, which consists of slightly opening the seam by pressing in the outside wall on either side of the seam and injecting the sealing compound into the spacer from the outside through the opening thus formed, whereby the compound spreads in the waist around the linear connector and sealingly closes the entire seam, including the opening formed for injecting the sealing compound, from the inside, more particularly reliably at the critical outside wall of the hollow profile bar, from where the sealing compound is injected. During injection, the back pressure in the sealing compound is desirably the greatest in the region of the waist between the bottom side of the linear connector and the outside wall of the hollow profile bar or spacer, so that the certainty of sealing the seam is likewise the greatest on the outside wall of the spacer.

The waist of the linear connector is preferably provided with a hole, which extends through the linear connector from the top side to the bottom side. This has the advantage that the sealing compound can be injected through an opening in the region of the seam onto the outside of the hollow profile bar or spacer into this hole, whereby the sealing compound can more easily reach the hollow space in the region of the waist between the top side of the linear connector and the inside wall of the spacer. In this way, excellent sealing of the seam between the two ends of the hollow profile bar from the inside is achieved not only on the outside wall, but also on the inside wall of the spacer.

The continuous hole from the top side to the bottom side through the linear connector is preferably cylindrical or has a cylindrical section and can be produced by drilling, for example. In an advantageous refinement of the invention, the hole is expanded at the bottom side of the linear connector, and more particularly it is expanded conically or in a wedge shape or convexly. This has the advantage that a nozzle, which has in particular a conical or wedge-shaped or convex front, can be used to push the outside wall of the spacer on either side of the seam into the expanded section of the hole, whereby easily a defined opening of the seam is obtained, through which the sealing compound can be directly injected from the nozzle into the hole of the linear connector.

On the top side and/or on the bottom side, and preferably on both of these sides of the linear connector, the waist is advantageously formed by a flat recess or chute, which extends from one lateral surface to the opposite lateral surface of the linear connector and transitions on the bottom side into the preferably provided expansion of the hole, or supplements the same. In this flat recess or chute, the injected sealing compound may optionally spread particularly easily over the entire clear width of the spacer, both on the top side and on the bottom side of the linear connector, and seal the joint in the spacer from the inside.

On the outside of the flanks, the hollow profile bar or the spacer is coated anyhow with a sealing compound, so that the seam there is or will be sealed already by the sealing compound applied from the outside onto the flanks. The joint in the spacer, however, is preferably also sealed from the inside in the region of the flanks. For this purpose, according to an advantageous refinement of the invention the waist is formed at both lateral surfaces of the linear connector by a recess, which is preferably delimited in a cylinder jacket-like manner, notably in a semicylindrical manner, and which extends from the top side to the bottom side of the linear connector. The—imaginary—cylinder axis of the recess delimited in a cylinder jacket-like manner runs transversely to the top side and bottom side of the linear connector, advantageously parallel to the two lateral surfaces of the linear connector, which likewise—at least outside of the waist—are preferably parallel to each other. The sealing compound injected into the spacer in the region of the joint can also seal the seam from the inside at the flanks of the spacer through such recesses. When injecting the sealing compound into the hole in the center of the waist, the sealing compound can flow in both directions around the linear connector, and can also cover the flanks of the hollow profile bar from the inside in the region of the joint and, in this way, ultimately again reach the side of the linear connector on which the joint was opened by pushing in the outside wall of the hollow profile bar for injecting the sealing compound.

It is even better to configure not only one, but two recesses on each of the two lateral surfaces of the linear connector, the recesses preferably being delimited in a cylinder jacket-like manner, notably in a semi-cylindrical manner. In this way, it is easier for the sealing compound to completely spread around the linear connector in the region of the waist and perfectly seal the seam from the inside at the joint of the spacer on the entire circumference of the joint.

It is particularly advantageous when the recesses provided on the lateral surfaces of the linear connector extend to the two ends of the flat recesses forming the waist at the bottom side, and preferably also at the top side, of the linear connector. In this way, it is ensured in the easiest way that the sealing compound fills in the waist in every nook and cranny.

As an alternative, it is possible to provide a recess on either lateral surface of the linear connector, the recess extending over the entire length of the waist provided at the top side and at the bottom side. As will be explained in more detail hereafter, however, it is easier to form recesses delimited in a semi-cylindrical manner, because these can be produced efficiently by drilling.

The cylinder jacket area of the recesses at the two lateral surfaces of the linear connector preferably extends over a circumferential angle of no more than 180° C. This provides an advantage in the preferred production method of the linear connector:

The preferred method for producing the linear connector is tied to the teaching of WO 2006/092314 A1, which refines the same in a non-obvious manner. The method is intended to provide a linear connector having the characteristics of claim 10, according to which the waist of the linear connector is formed at the two lateral surfaces by a recess that is preferably delimited in a cylinder jacket-like manner, which extends from the top side to the bottom side of the linear connector and the cylinder axis of which runs transversely to the top side and bottom side of the linear connector. Such a linear connector is produced from a strand-shaped semifinished product having a constant cross-section over the length thereof. "First" holes are drilled into this semifinished product, which are continuous from the top side to the bottom side of the strand-shaped semifinished product and disposed at a distance from each other in the longitudinal direction of the semifinished product. The holes are drilled in a center region between the longitudinal edges of the strand-shaped semifinished product, preferably either exactly in the center, or the first holes are drilled in pairs and disposed so that the drilling axes of each pair of holes are located next to each other in a plane perpendicularly intersecting the longitudinal center line of the strand-shaped semifinished product. To this end, the drilled first holes of each such pair may be disposed at a distance from or overlap each other. The distance of the drilling axes from adjoining first holes in the longitudinal direction of the semifinished product corresponds approximately to the width of the linear connectors to be produced. The linear connectors are severed from the semifinished product by placing severing cuts such that each severing plane runs transversely, and particularly perpendicularly, to the longitudinal direction of the semifinished product and contains the drilling axis of the first holes or—if the holes are drilled in pairs next to each other—contains the drilling axes of the pairs of first holes.

This way of proceeding offers considerable advantages:

The strand-shaped semifinished products required for the method according to the invention can be produced inexpensively, either by extrusion pressing from metal, notably aluminum or an aluminum alloy, or by extruding plastic. The use of a strand-shaped semifinished product made of plastic is preferred because plastic materials are less expensive than aluminum and because of the lower thermal conductivity thereof, as compared to metals, make it possible to produce insulating glass panes that have a lower heat transmission coefficient than is the case for spacers made of metallic hollow profile bars. Plastic materials having strength that satisfies the typical usage conditions in an insulating glass pane are known to the person skilled in the art. Suitable materials include polyamides, polyethylene, polypropylene, polystyrene, polycarbonate, polytetrafluoroethylen, and EPDM, an ethylene-propylene terpolymer.

Strand-shaped semifinished products can be transported cost-effectively and in a more space-saving manner and stocked as linear connectors molded separately.

The strand-shaped semifinished products can be procured from a supplier or produced directly by the insulating glass manufacturer.

Producing the linear connectors by severing from a prefabricated strand-shaped semifinished product is very cost-effective, especially also because linear connectors having different widths can be produced from one and the same strand-shaped semifinished product.

According to the invention, no devices are required and no expenditures for stocking linear connectors having different widths are incurred.

According to the invention, no oscillating conveyors or similar apparatuses for separating and feeding linear connectors having different widths are required.

From the time they are produced by severing from the semifinished product until they are inserted in a hollow profile bar, the linear connectors remain under positive mechanical control in that they remain between grippers throughout this time period. Arbitrary, random movements that could make it difficult to grip and insert the linear connectors can thus be eliminated.

The sequence of motions from gripping the linear connector to be severed from the semifinished product until it is inserted into a hollow profile bar can be highly simplified and automated. The sequence of motion can be predetermined with repeatable consistency, even for linear connectors having different widths, and enables high operating speeds, and consequently short cycle times for producing frame-shaped spacers for insulating glass panes.

Because the severing cuts are placed in the drilling axes of the "first" holes, a borehole also forms a recess in the lateral surface of the linear connector created by the subsequent severing step in two consecutive linear connectors. If the severing tool were extremely thin, the recesses would have a semicircular shape when viewed from above. Due to the finite thickness of the severing tool, however, part of the material of the linear connector is lost by the severing cut, so that in fact the angle of circumference of the cylindrically delimited recess is slightly less than 180° C. This is the spirit in which the information in the claims should be understood, according to which the cylinder jacket area of the recess extends over a circumferential angle of "no more than 180° C.". And this is also the spirit in which the information of any method or method claims should be understood, according to which the distance of the drilling axes of adjoining first holes in the longitudinal direction of the semifinished products corresponds "approximately" to the width of a linear connector to be produced; because the location of the drilling axes of the recess is severed by the severing cut from the linear connector, the linear connector however is to be inserted without play in the spacer, the distance of the two drilling axes of the recesses of the linear connector measured in the longitudinal direction of the semifinished product is marginally larger than the width of the linear connector to be formed.

The linear connector severed from the semifinished product is preferably inserted into the hollow profile bar using the same gripper that already holds it when it is severed from the semifinished product. This is the simplest method in terms of the equipment and sequence of motions. However, it is also possible to have the linear connector transferred from the gripper holding it during severing from the semifinished product to a second gripper and inserted it into the hollow profile bar by the same. When proceeding in this way, shorter cycle times can be achieved, because the severing process and the insertion into a hollow profile bar can be carried out at the same time.

Preferably additionally "second" holes are drilled into the strand-shaped semifinished product, which likewise are continuous from the top side to the bottom side of the semifinished product, and more specifically sp that a second hole is located between two first holes, respectively. This second hole is preferably located exactly in the center between the two adjoining first holes when these are located only in a single row extending in the longitudinal direction of the strand-shaped semifinished product. However, when the "first" holes are drilled in pairs next to each other, so that two holes have drilling axes that are disposed at a distance from each other transversely to the longitudinal direction of the semifinished product and are located in a common plane, then each of the "second" holes is located between two such adjoining planes, preferably in the center of two such adjoining planes.

After inserting the linear connector into a hollow profile bar or spacer, the sealing compound is preferably injected into this "second" hole so as to seal the joint between the two ends of the hollow profile bar of which the spacer is or will be produced. The second holes are preferably narrower than the first holes, or the first holes are wider than the second holes. This ensures not only sufficient mechanical stability, but also recesses in the lateral surfaces of the linear connector, which are large enough to achieve reliable sealing of the seam between the ends of the hollow profile bar.

So as to form a defined abutment for the nozzle used to inject the sealing compound, it may be advantageous to expand the second holes at the bottom side of the semifinished product, for example by conically boring them using the conical tip of a drill.

A particular advantage of the invention is that linear connectors having different widths can be severed from the strand-shaped semifinished product in arbitrary sequence for spacers having different widths. It is possible just as easily to suitably select the locations at which the first and second holes must be drilled. Controlling the advancement of the strand-shaped semifinished product toward a severing tool and positioning drills along the strand-shaped semifinished product for drilling the first and second holes can be carried out automatically according to the specifications of a computer-aided manufacturing controller (CAM=computer-aided manufacturing).

BRIEF DESCRIPTION OF THE DRAWINGS

Embodiments of the invention are shown in the attached drawings. Identical or corresponding parts are denoted with agreeing reference numerals in the different figures.

DETAILED DESCRIPTION

Figure 1:
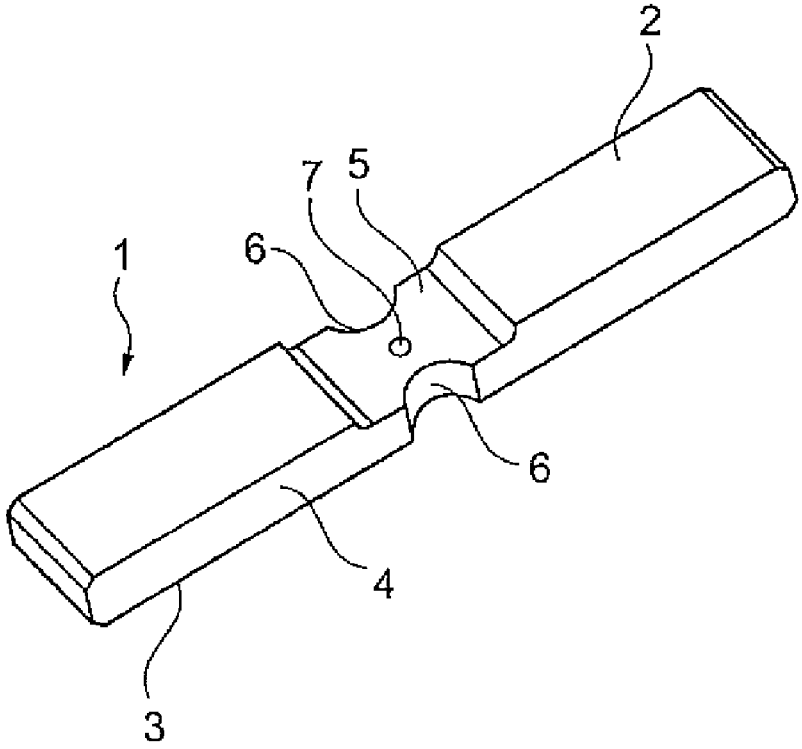
FIG. 1 shows an oblique view of a linear connector for connecting two ends of a hollow profile bar, of which a spacer for insulating glass panes is to be produced.
Figures 2, 3:
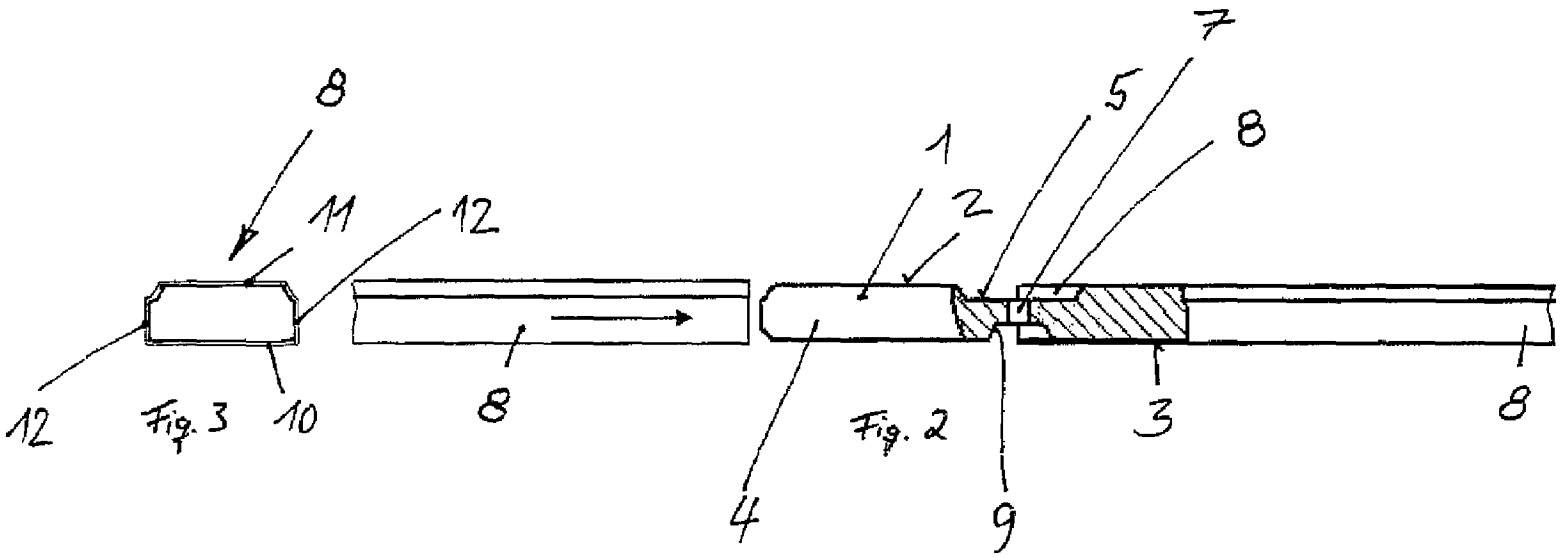
FIG. 2 shows the linear connector of FIG. 1 in a partially longitudinally cut view, and specifically in a position in which it is inserted half into one end of a hollow profile bar, and thereafter is inserted half into an opposing end of a hollow profile bar.
FIG. 3 shows the hollow profile bar of FIG. 2 in a view toward the end thereof, so that the profile shape is visible.
Figure 5:
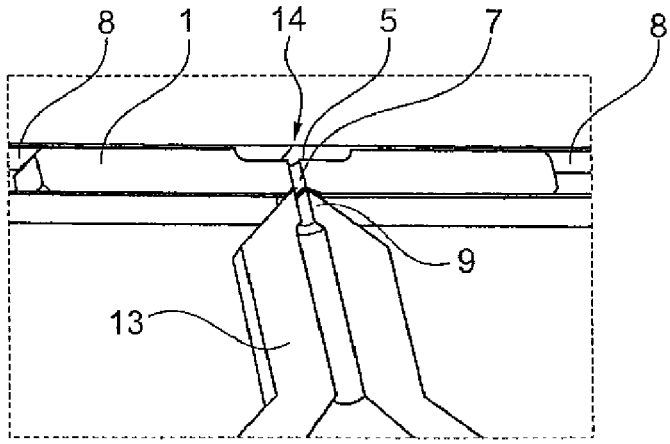
FIG. 5 shows the assembly of the linear connector in two mutually opposing ends of the hollow profile bar before injecting a sealing compound in a perspective longitudinal section of a spacer, which is formed by a hollow profile bar as in FIG. 3, and of the linear connector of FIG. 1.
Figure 6:
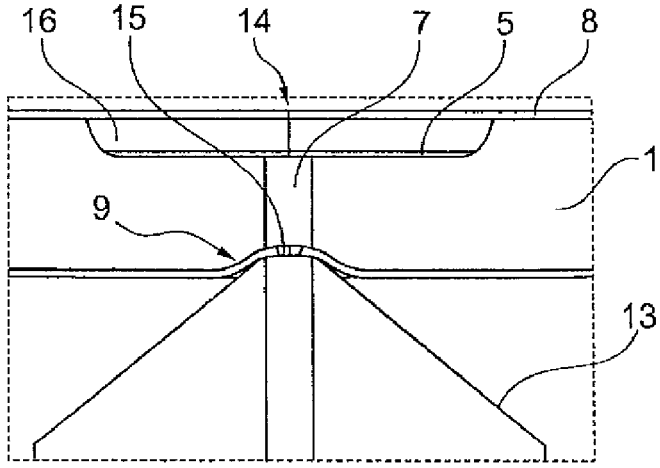
FIG. 6 is an enlarged view of the state after injecting the sealing compound in a longitudinal section of the spacer in the region of the linear connector.

The linear connector 1 shown in FIG. 1 is a straight insert part, which is configured mirror-symmetrically to the center plane thereof cutting the linear connector 1 in half in length. The linear connector 1 has a top side 2, a bottom side 3, and two longitudinal sides 4. The longitudinal sides 4 are provided with two recesses 6, which in the top view have a circular arc shape, and in particular an approximately semicircular shape. In addition, a flat recess 5 is provided in the center of the tap side 2, in the center of which a continuous hole 7 extending from the top side 2 to the bottom side 3 is located, and particularly a borehole. The width and thickness of the linear connector 1 are adapted to the clear width of the hollow profile bar 8, the ends of which the linear connector 1 is intended to connect so as to form a spacer for insulating glass panes. For this purpose, the linear connector 1 is located without play in the hollow profile bar 8 after having been inserted therein. The hole 7 preferably widens conically or in a wedge shape or convexly toward the bottom side 3, as is shown in FIGS. 2, 5, and 6. In this way, the linear connector 1 is surrounded by a waist through which the hole 7 passes. The waist is composed of the flat recess 5, the lateral recesses 6, and the expansion 9 of the hole 7.

The linear connector 1 has preferably already been inserted into the one end of the hollow profile bar 8 after the bar has been cut to the length necessary for producing a spacer and before the corners of the spacer are bent. Advantageously, the linear connector 1 is inserted into the one end of the hollow profile bar 8 with half of the length thereof. In order to close the spacer, the free end of the linear connector 1 is inserted into the opposite end of the hollow profile bar 8, see FIG. 4. To ensure that it is not pushed deeper than by half the length thereof into the end of the hollow profile bar 8 into which it was inserted first, it is temporarily clamped, for example using tongs used to act on the outside wall 10 and inside wall 11 of the hollow profile bar 8.

The hollow profile bar 8 is typically produced from thin-walled aluminum or stainless steel, preferably from stainless steel, and has a hollow profile as that which is shown in FIG. 3, comprising an outside wall 10, which is directed toward the outside after installing the spacer into an insulating glass pane, an inside wall 11, which is disposed opposite of the outside wall 10 and faces the inner chamber of the insulating glass pane after installing the spacer into an insulating glass pane, and two flanks 12, which connect the outside wall 10 and the inside wall 11 to each other and are coated with an adhesive and sealing compound, which is used to glue the two glass panes of an insulating glass pane together so as to assure the mechanical cohesion thereof and seal the inner chamber of the insulating glass pane against penetrating moisture. The inner chamber of the hollow profile bar 8 is typically filled with a granular desiccant, which is intended to absorb moisture from the inner chamber of the insulating glass pane. In this case, the inside wall 11 is perforated. However, it is also possible to embed the desiccant into an adhesive and/or sealing compound and dispose it on the inside wall 11 or on the flanks 12 of the hollow profile bar 8. In this case, a perforation of the inside wall 11 of the hollow profile bar 8 can and should be eliminated.

Figure 4:
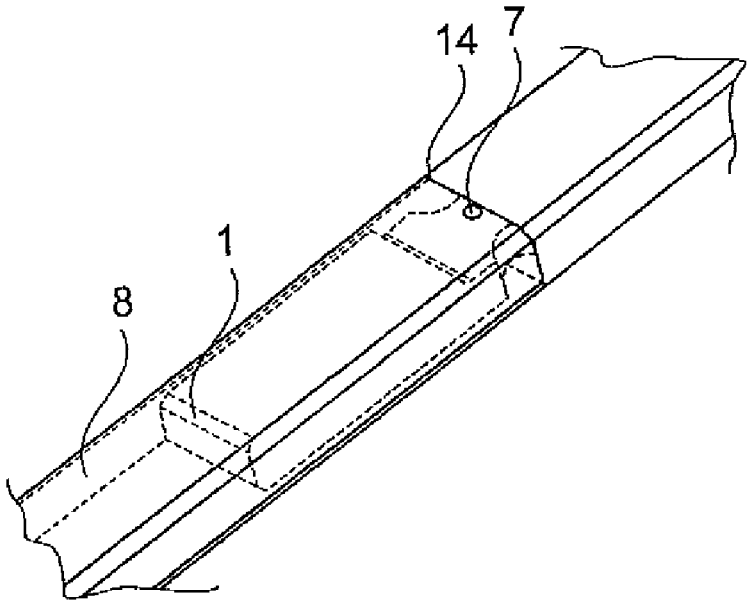
FIG. 4 shows an oblique view of the linear connector according to FIG. 1 inserted into the two ends of a hollow profile bar or into ends of two hollow profile bars to be connected, wherein the hollow profile bar is illustrated partially transparent to show the position of the linear connector.

After the two ends of the hollow profile bar 8 have butted, which is shown in FIG. 4, the outside wall 10 of the hollow profile bar 8 is pushed over the conical, wedge-shaped or convex expansion 9 of the hole 7 with a nozzle 13, which has a matching conical, wedge-shaped or convex tip, into the conical or wedge-shaped or convex expansion 9 of the hole 7 (see FIG. 6), wherein an opening 15, through which a sealing compound 16 can be injected into the hollow profile bar 8 using the nozzle 13, is formed in the seam 14 between the two ends of the hollow profile bar 8. The sealing compound 16 flows through the hole 7 into the flat recess 5 on the opposite side of the linear connector 1, spreads there uniformly to all sides, and flows through the lateral recesses 6 to the two flanks 12, and on to the inside of the outside wall 10 of the hollow profile bar 8. In this way, the seam 14 between the two ends of the hollow profile bar 8 is completely sealed from the inside, without the sealing compound 16 exiting the seam 14. The seam 14 is thus not only reliably sealed, it is also very inconspicuous, which is advantageous for the appearance of the spacer in the insulating glass pane. The position of the linear connector 1 in the two ends of the hollow profile bar 8 is secured by pushing the outside wall 10 into the expansion 9 of the hole 7 and by the injected sealing compound 16.

FIG. 5 shows the assembly of the linear connector 1 in the hollow profile bar 8 prior to injecting the sealing compound 16 using the nozzle 13, which has already pressed in the outside wall 10 of the hollow profile bar 8 for this purpose in a conical or wedge-shaped or convex manner, in a perspective longitudinal section of a hollow profile bar 8 and of the linear connector 1.

FIG. 6 shows an enlarged view of the state after injecting the sealing compound 16 in a longitudinal section of the hollow profile rod 8.

Figure 7:
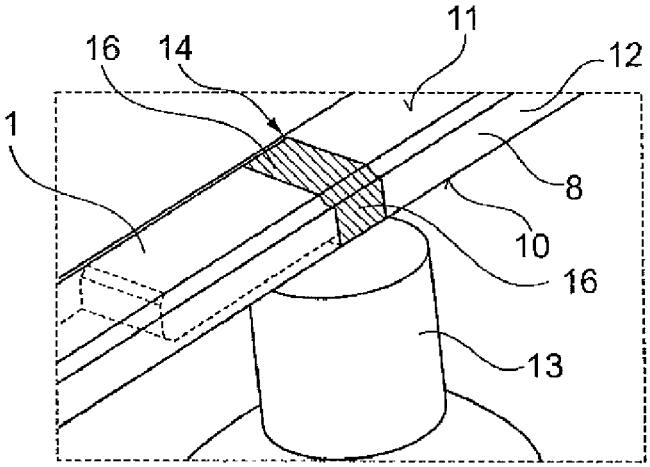
FIG. 7 shows in an oblique view of the partially transparent spacer or hollow profile bar how the sealing compound spreads around the linear connector at the joint between the ends of the hollow profile bar.

FIG. 7 shows in an oblique view of the hollow profile bar 8 shown in a transparent manner how the sealing compound 16 spreads around the linear connector 1 at the joint between the ends of the hollow profile bar 8.

The beginning and end of one and the same hollow profile bar 8 may abut at the joint with the seam 14, which is held closed by the linear connector 1. However, it is also possible for the end of a first hollow profile bar and the beginning of a second hollow profile bar to abut at the joint, which are processed together to form a spacer for an insulating glass pane. In this case, the two other ends of these two hollow profile bars 8 are likewise connected to each other by such a linear connector 1 when closing the spacer, so that the spacer comprises two linear connectors 1.

A stop preventing the linear connector 1 from being pushed into the hollow profile bar by more than half the length is not provided on the linear connector 1. This is not required either, because this can be ensured in a different manner. For example, as mentioned above, when placing the second end of a hollow profile bar 8 onto the linear connector 1 protruding half out of the first end of the hollow profile bar 8, this connector can be prevented from being pushed more than half the length thereof into the hollow profile bar 8 by gripping the hollow profile bar 8 at the outside wall 10 and at the inside wall 11 and pressing it against the linear connector 1, so that the same is held by increased static friction.

Figure 8:
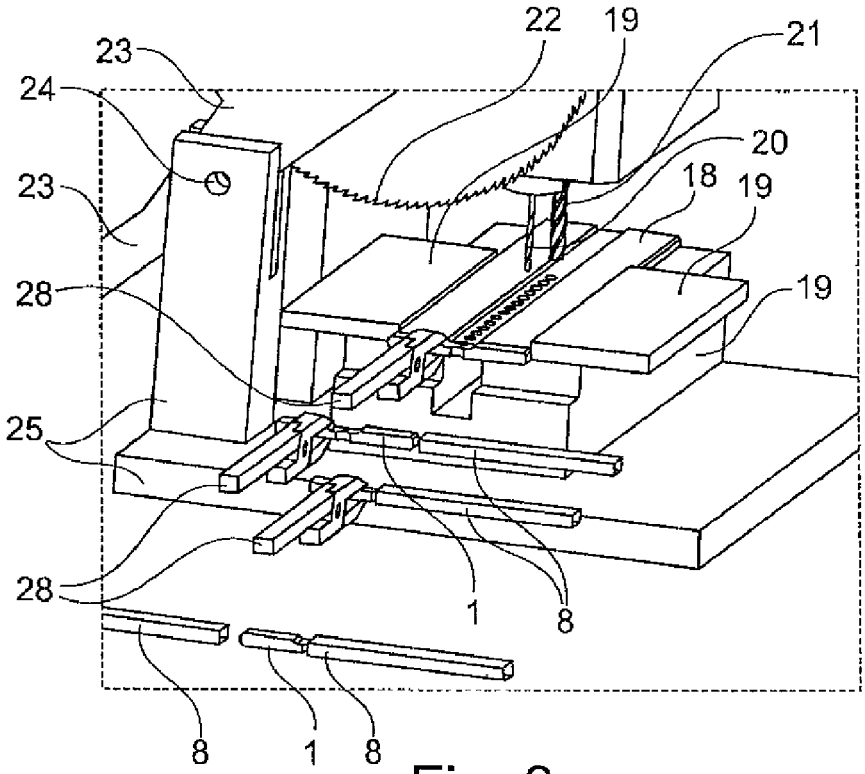
FIG. 8 shows an oblique view of a device for producing such linear connectors.
Figure 9:
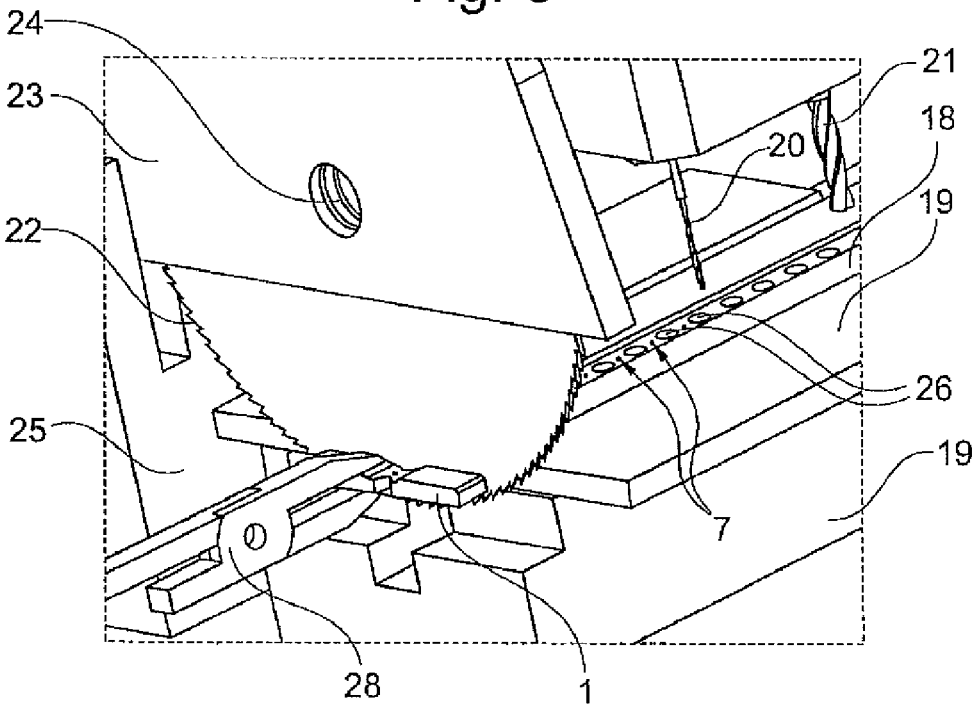
FIG. 9 shows a cut-out of the device of FIG. 8 during the severing phase of a linear connector from a strand-shaped semifinished product.

FIGS. 8 and 9 are used to explain an advantageous method for producing the linear connector 1 shown in FIGS. 1 to 7. To this end, a strand-shaped semifinished product 18 is used as the starting product, which has a profile shape, as that shown for the lateral wall 4 of the linear connector 1 illustrated in FIG. 1. This semifinished product 18, which may have been produced by extrusion, is fed preferably horizontally on a guide device 19 to processing tools 20-22, more specifically two drilling tools comprising a thinner drill 20 and a thicker drill 21 and a severing tool 22, which is a rotatably driven saw blade mounted in a pivotable mounting 23 so as to pivot about a horizontal axis 24 in a stand 25, which also carries the guide device 19. The drills 20 and 21 are disposed so as to move up and down, but are otherwise stationary. An advancing device, which is not shown, incrementally advances the semifinished product 18 by such lengths that first holes 26 are drilled using the thicker drill 21, the distance of these holes being selected, for example in a computer-assisted manner, so that the distance of the drilling axes of two adjacent first holes 26, respectively, corresponds to the width of the particular linear connector 1 to be produced. If necessary, the lengths of the cuts can be varied from case to case, so that linear connectors 1 having different widths can be produced in any arbitrarily desired succession.

The thinner drill 20 is used to drill a second hole 7 in the center between two first holes 26, respectively.

The linear connectors 1 are severed from the strand-shaped semifinished product 18 in such a way that the saw blade 22 places the severing cut exactly through the center of each first hole 26. During the severing cut, the resulting linear connector 1 is held by tongs 28, by which, as is shown schematically in FIG. 8, the linear connector 1 severed from the semifinished product 18 can be placed mechanically directly into a hollow profile bar 8 positioned next to the assembly of the processing tools 20, 21, 22 using a strictly translatory movement. This allows very efficient operation. Of course manual operation is also possible, however this is less efficient.

The embodiment shown in FIGS. 1 to 9 may be modified to the extent that the strand-shaped semifinished product 18 and, together with the same, the linear connector 1 produced therefrom comprise flat recesses 5 not only on the top side 2, but accordingly also on the bottom side 3. This makes it easier for the sealing compound 16 injected into the spacer through the "second" hole 7 to spread around the linear connector 1, filling the waist all the way around.

Figure 10:
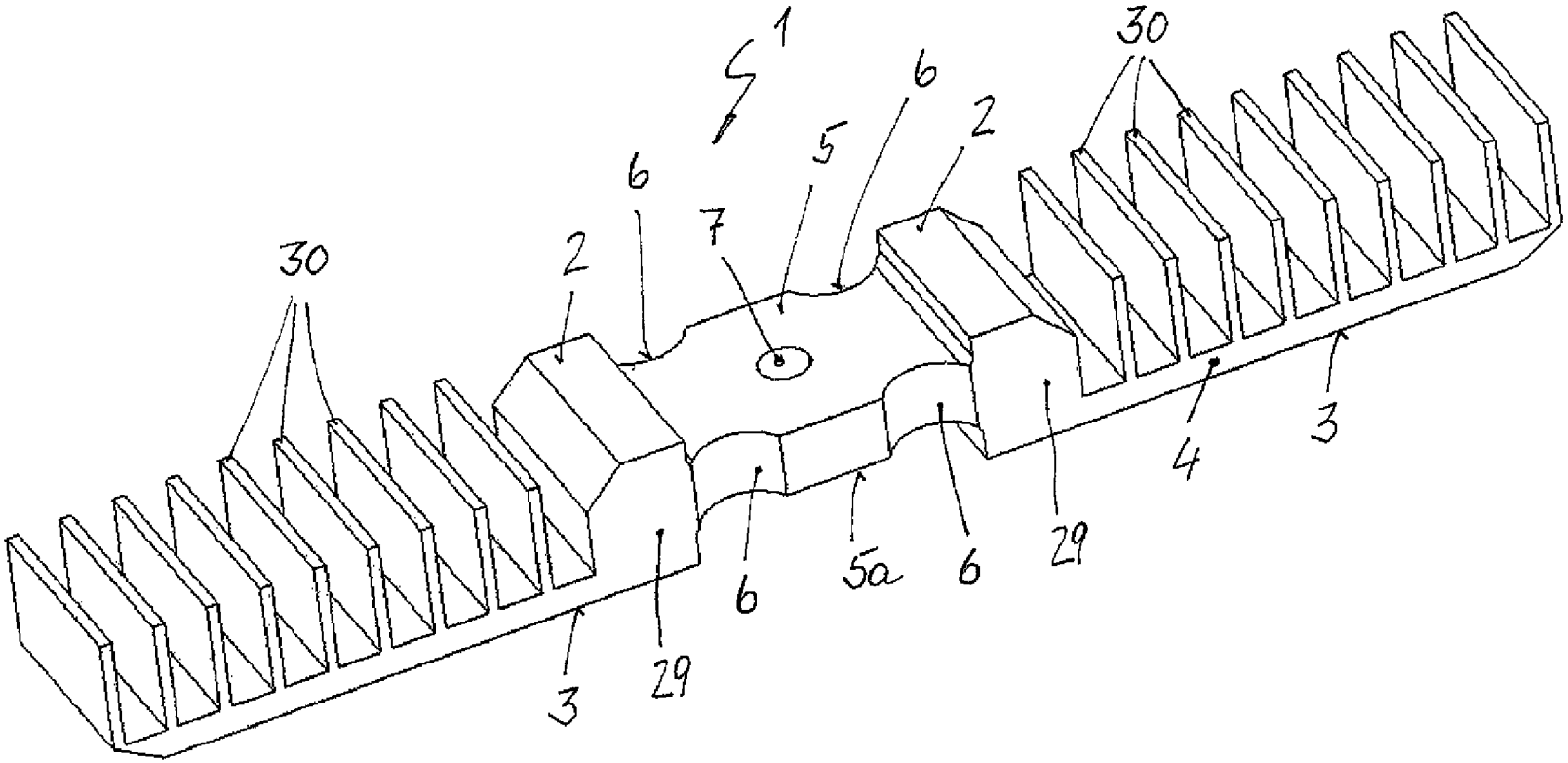
FIG. 10 shows an oblique view of another example of a linear connector, which is formed by a strand-shaped semifinished product.

The linear connector 1 shown in FIG. 10 is a straight insert part having a top side 2, a bottom side 3, and two lateral sides 4. The longitudinal sides 4 are provided with two recesses 6, respectively, which in the top view have a circular arc shape, and in particular an almost semicircular shape. A flat recess 5 is provided in the center of the top side 2. A corresponding flat recess 5*a* is provided on the bottom side 3 of the linear connector 1. A continuous 7 extending from the top side 2 to the bottom 3 is provided in the center of the linear connector 1, notably a borehole. The recesses 5, 5*a* are delimited by two blocks 29, the height of which measured between the top side 2 and the bottom side 3 agrees with the clear height of the hollow profile bar 8 for which the linear connector 1 is intended, see FIG. 11 and FIG. 12. Between the ends and the blocks 29, the linear connector 1 comprises a series of fins 30, which extend from the wall that forms the bottom side 3 of the linear connector 1. The fins 30 run perpendicularly to the longitudinal direction of the linear connector 1 and protrude over the plane in which the two top sides 2 of the blocks 29 are located. This causes the fins 30 to be bent in the direction of the blocks 29 when the linear connector 1 is inserted into a hollow profile bar 8, see FIG. 12. The height of the linear connector 1 in the region of the fins 30 is thus slightly larger than the clear height of the hollow profile bar 8. This has the advantage that the bent fins 30 make it more difficult to pull out the linear connector 1 at the ends of the hollow profile bar 8.

Like the linear connector shown in FIG. 1, the linear connector 1 shown in FIG. 10 may be produced from a strand-shaped semifinished product. The method for the production thereof described based on FIGS. 8 and 9 is also suited for producing the linear connector 1 shown in FIG. 10, more specifically with the particular feature that, contrary to the description provided in connection with FIGS. 8 and 9, not only a single hole 26 is drilled between two "second" holes 7, respectively, but two such holes are drilled, the drilling axes of which are located at a distance next to each other in a plane intersecting the longitudinal direction of the semifinished product 18 and later, due to the subsequent severing cuts using the saw blade 22, become the almost semi-cylindrical recesses 6, of which two are provided on each longitudinal side 4 of the linear connector 1. In order to achieve this, the drilling tool 21 can be moved back and forth transversely to the longitudinal direction of the semifinished product 18 by the distance of the drilling axes of the "first" holes so as to drill pairs of "first" holes, which become pairs of almost semi-cylindrical recesses 6 during the subsequent severing cut using the saw blade 22.

Figure 11:
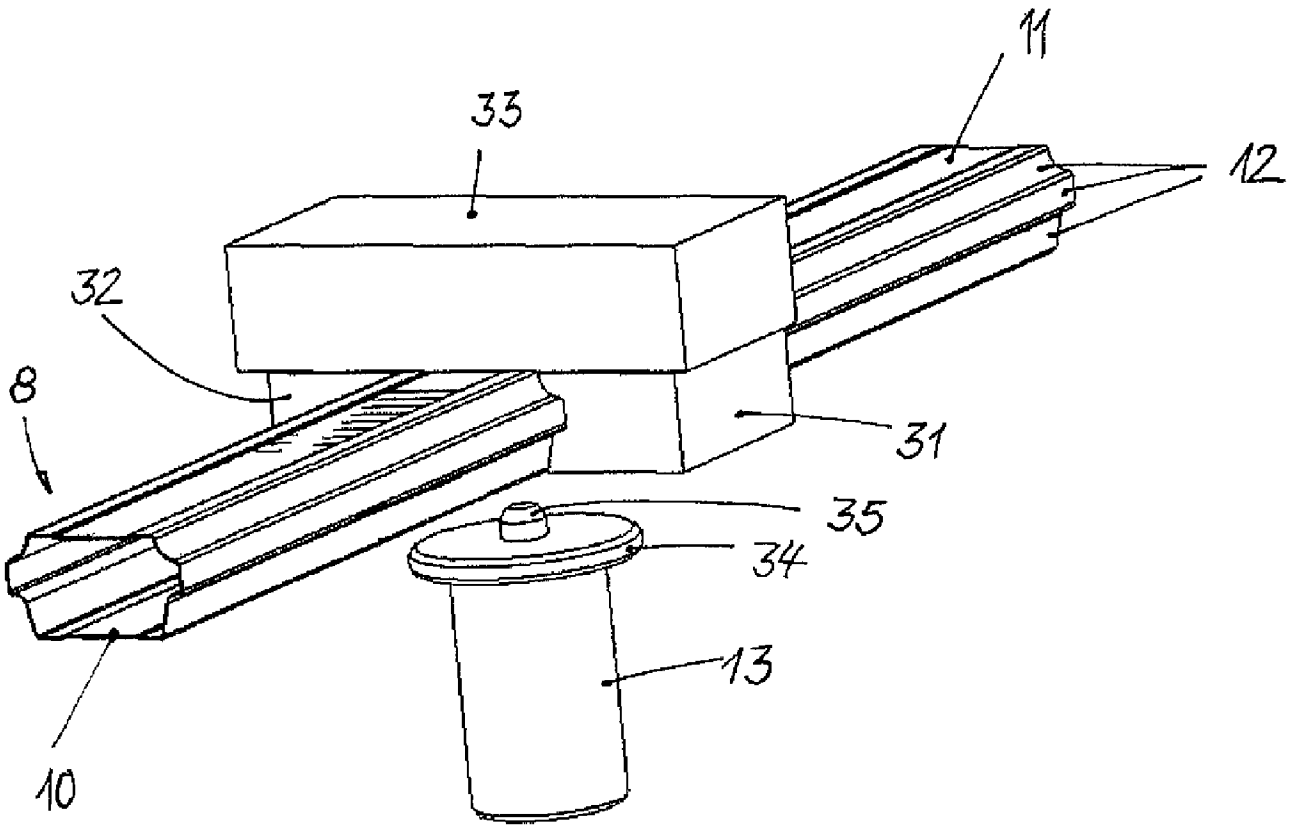
FIG. 11 shows an oblique view of a hollow profile bar having a cross-sectional shape that is modified as compared to FIGS. 2 to 7, wherein the two ends of the hollow profile bar to be connected to each other are held between clamping jaws in preparation for the injection of sealing compound.
Figure 12:
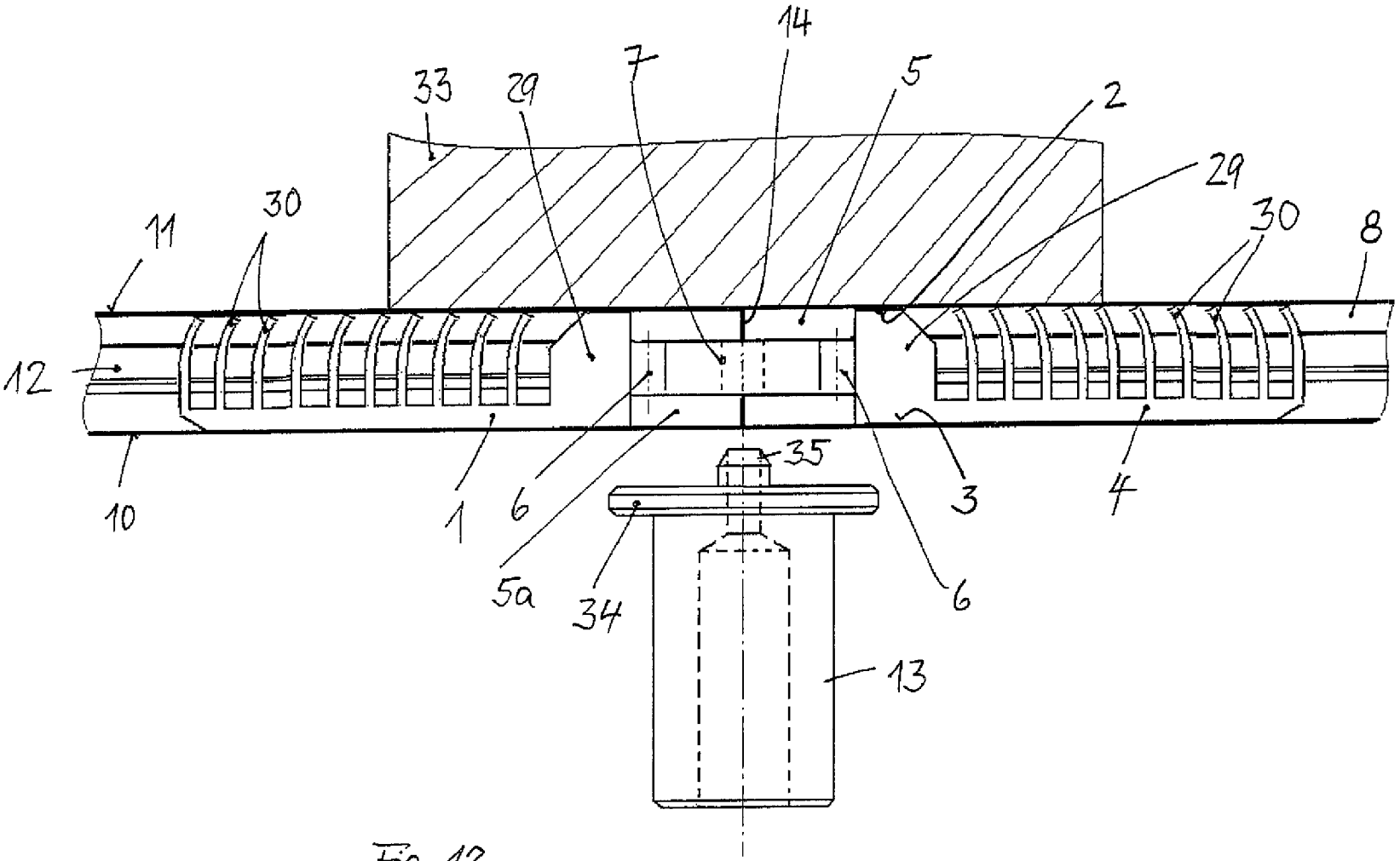
FIG. 12 shows a longitudinal section of the assembly of FIG. 11, wherein the cutting plane intersects the outside wall and the inside wall of the hollow profile bar at the center.

FIG. 11 shows two end sections of a hollow profile bar 8, which abut with the two ends thereof between two clamping jaws 31 and 32. The clamping jaws 31 and 32 having clamping surfaces, the contours of which are closely adjusted to the contours of the flanks 12 of the hollow profile bar 8, so that they seal the seam present at the joint, which in FIG. 11 is covered and therefore not visible, from the outside. An abutment 33 is located on the inside wall 11 of the hollow profile bar 8 and seals the seam between the ends of the hollow profile bar 8 in the region of the inside wall 11. A nozzle 13 is located opposite of the abutment 33, the nozzle being surrounded by a flat collar 34, over which a mouth 35 of the nozzle protrudes, the outer lateral area of which is conically tapered. The mouth 35 of the nozzle 13 is oriented toward the outside wall 10 of the hollow profile bar 8 and is directed exactly at the seam 14 between the two abutting ends of the hollow profile bar 8, see FIG. 12. It should be mentioned again that the inside wall 11 of the hollow profile bar 8 denotes the wall which faces the inner chamber of the insulating glass pane after an insulating glass pane has been installed, while the outside wall 10 of the hollow profile bar 8 denotes the wall directed toward the outside after installation of an insulating glass pane.

Figure 13:
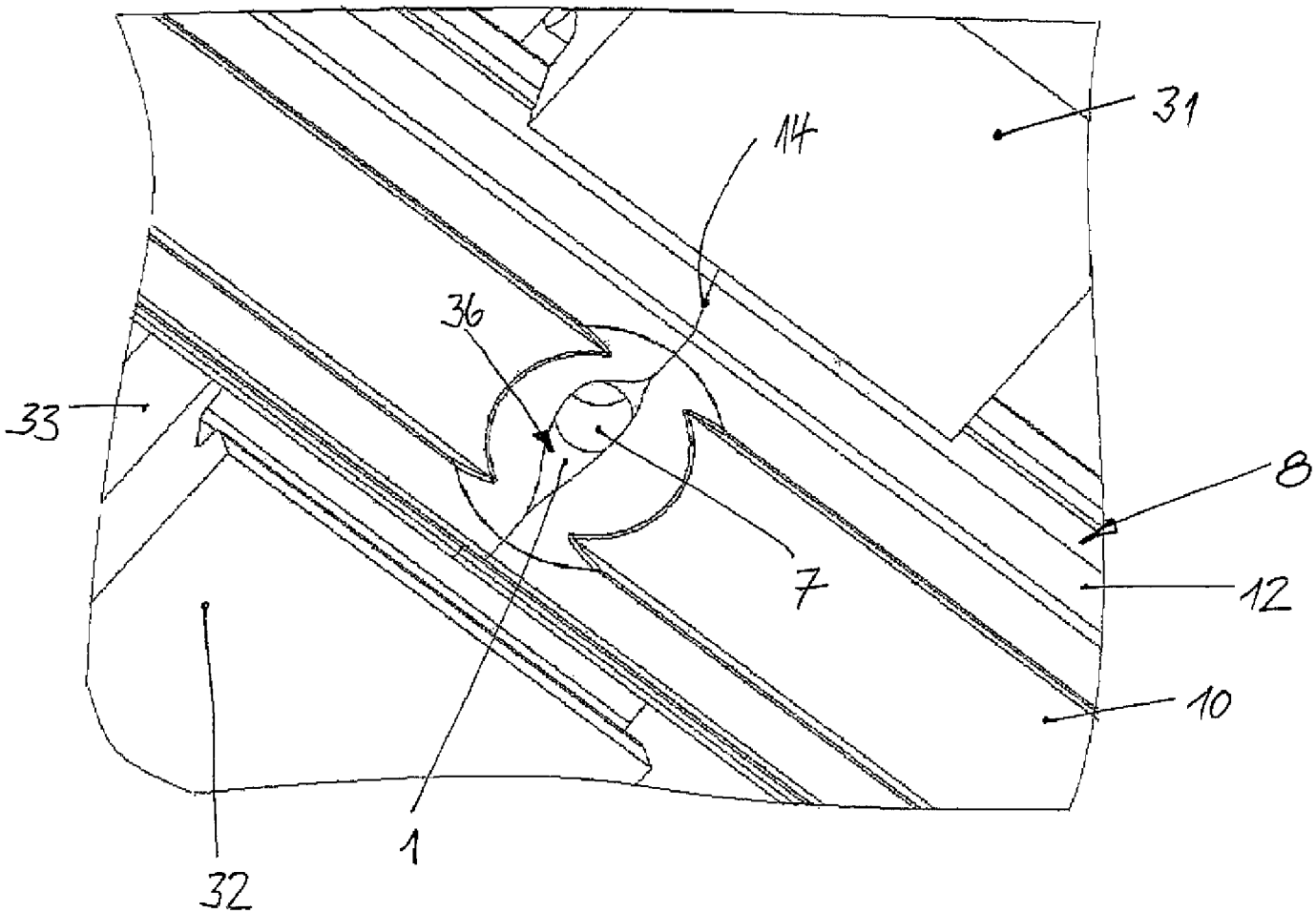
FIG. 13 shows an oblique view of the outside wall of the hollow profile bar in the region of the joint located between the clamping jaws between the two ends of the hollow profile bar.
Figure 14:
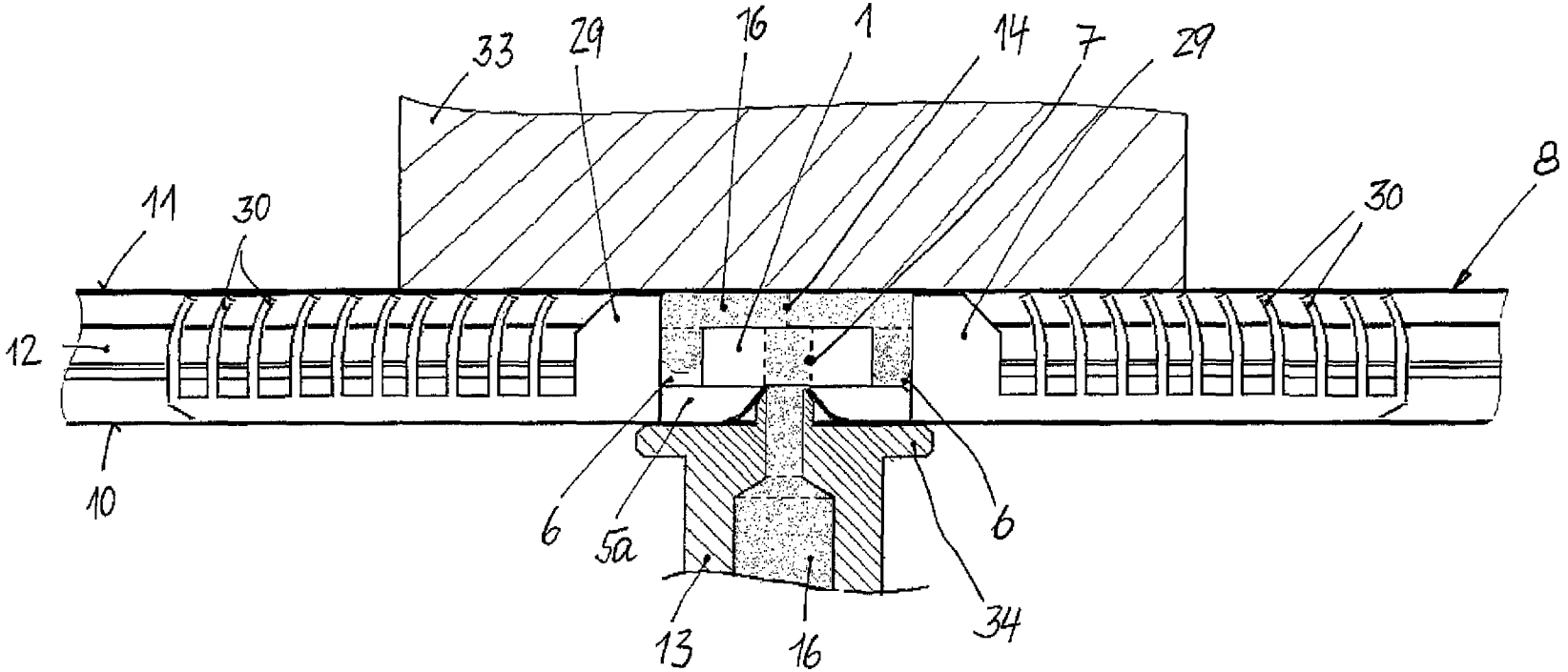
FIG. 14 shows a longitudinal section of the hollow profile bar according to FIG. 12, however while sealing compound is being injected.

The nozzle 13 pushes in the outside wall 10, extending over the seam 14. The forces required to do so are absorbed by the abutment 33. The forces are introduced from the collar 34 via the outside wall 10, the solid blocks 29, and the inside wall 11 into the abutment 33. The nozzle 13 is oriented so that the mouth 35 thereof is directed at the "second" hole 7 in the linear connector 1. As a result, the opening 36, which is created in the outside wall 10 when the nozzle pushes in the outside wall 10 with the mouth 35, is aligned with the second hole 7 in the linear connector 1, as is shown in FIG. 13. As soon as the outside wall 10 in the region of the seam 14 is pushed in, and the collar 34 is seated against the outside wall 10 and seals the seam 14 from the outside in the region of the outside wall 10, the sealing compound 16 is injected. The sealing compound 16 is injected directly into the second hole 7, reaches the flat recess 5 on the top side 2 of the linear connector 1, spreads there up to the blocks 29, flows into the almost semi-cylindrical recesses 6, and finally reaches the flat recess 5*a* on the bottom side 3 of the linear connector 1, see FIG. 14 and FIG. 15.

Figure 15:
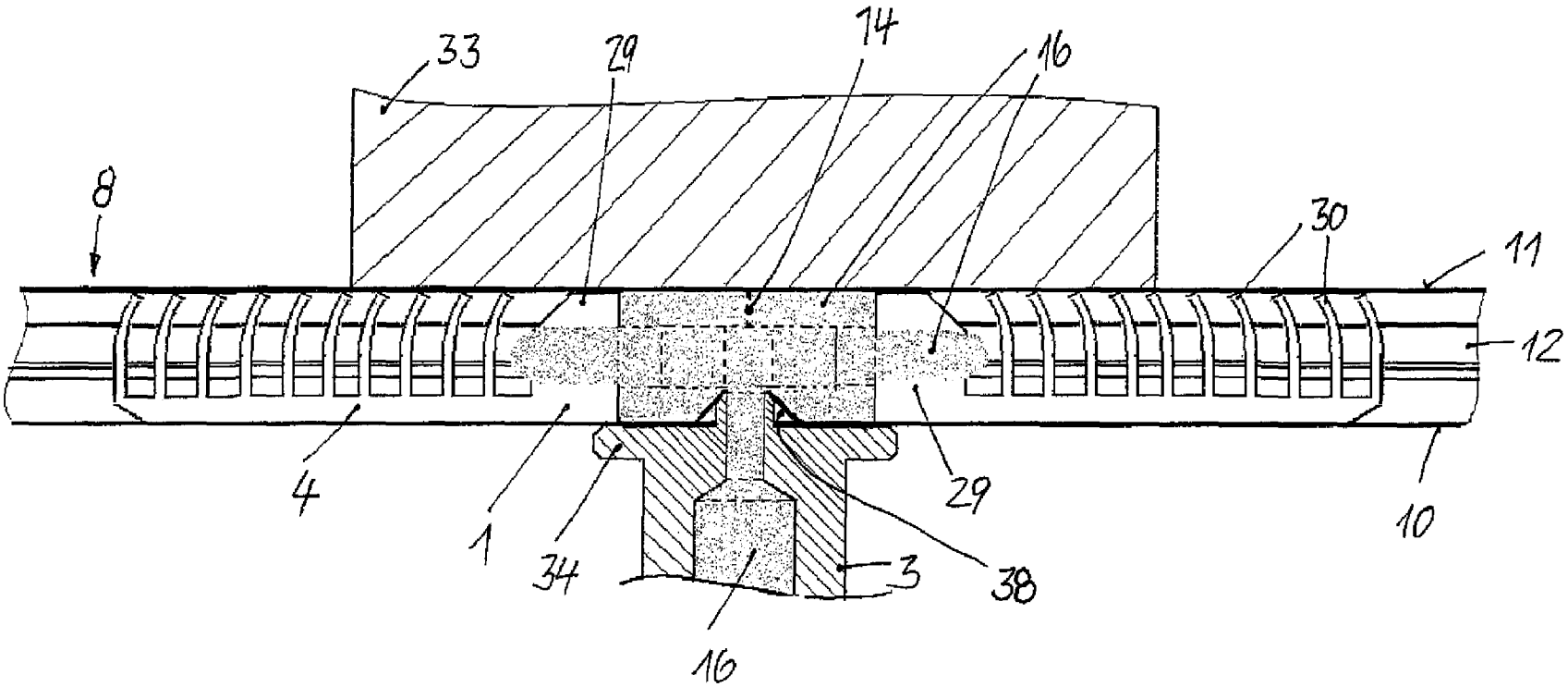
FIG. 15 shows a longitudinal section of a hollow profile bar as that in FIG. 14, however at the end of the process of injecting sealing compound into the hollow profile bar.
Figure 17:
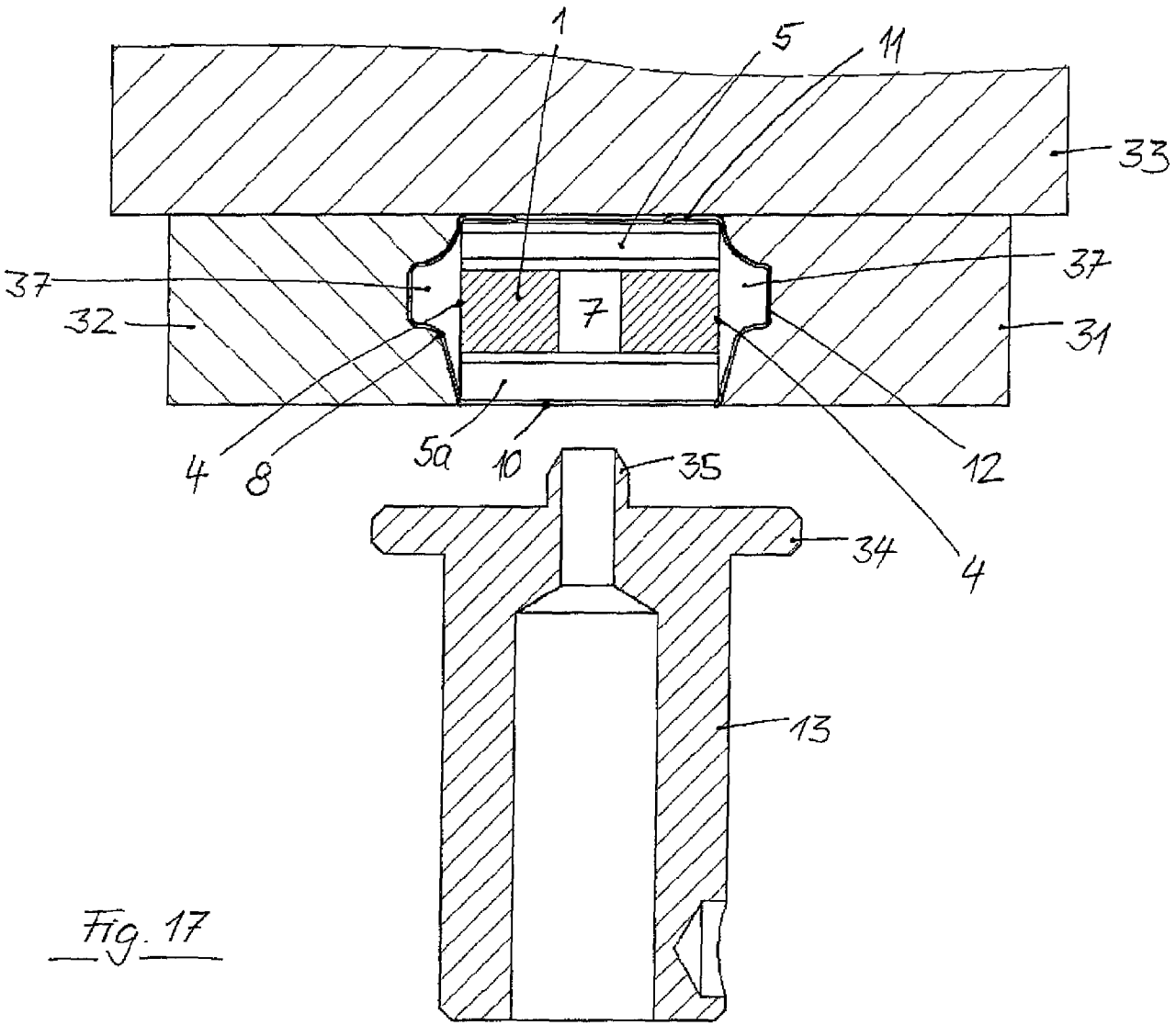
FIG. 17 shows a cross-section of the joint located between the clamping jaws between the two ends of the hollow profile bar according to FIG. 11 before injecting sealing compound.
Figure 18:
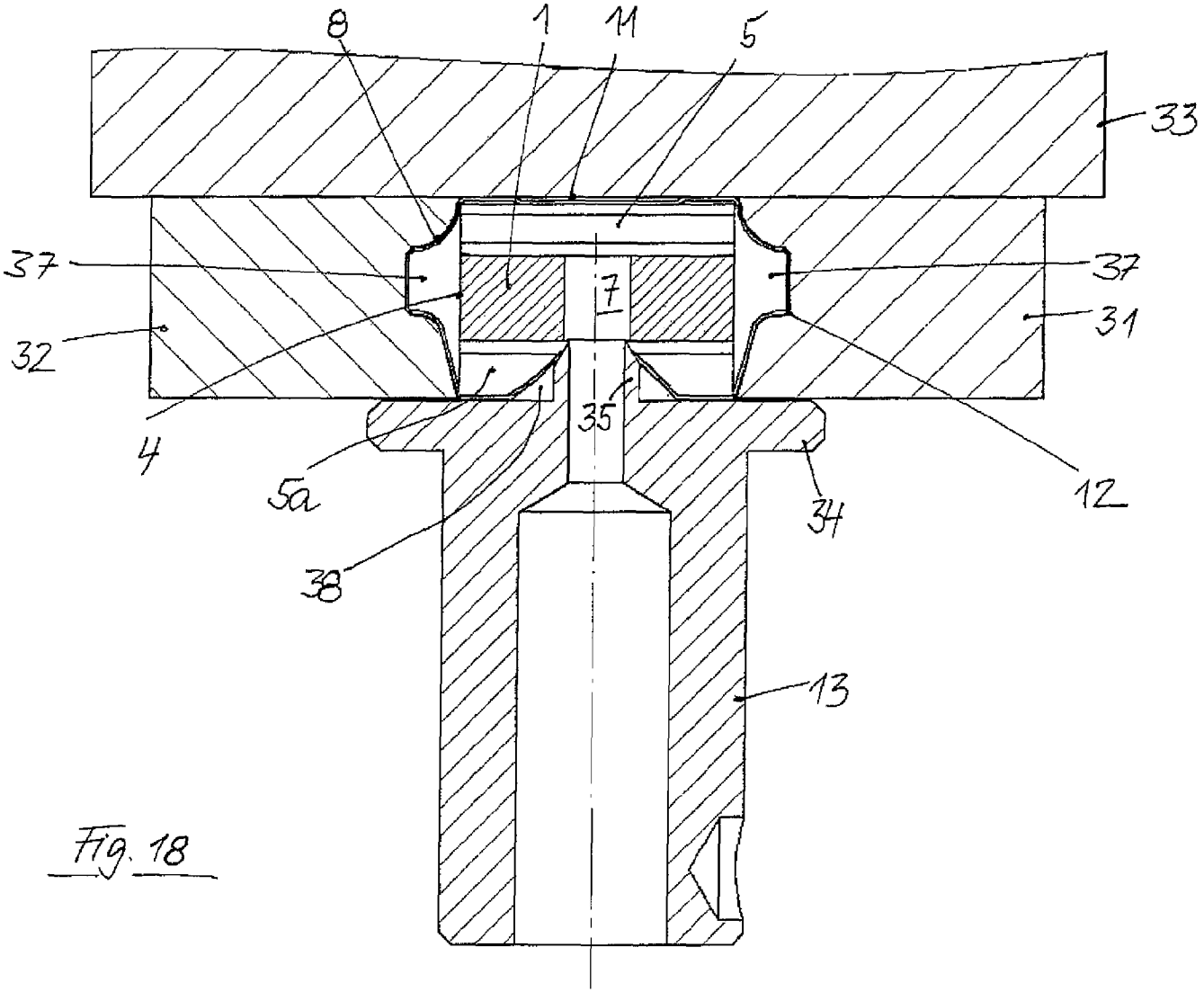
FIG. 18 shows the cross-section of the joint between the ends of the hollow profile bar as in FIG. 17, however after the outside wall of the hollow profile bar has been pushed in using the nozzle, by which the sealing compound is to be supplied.
Figure 19:
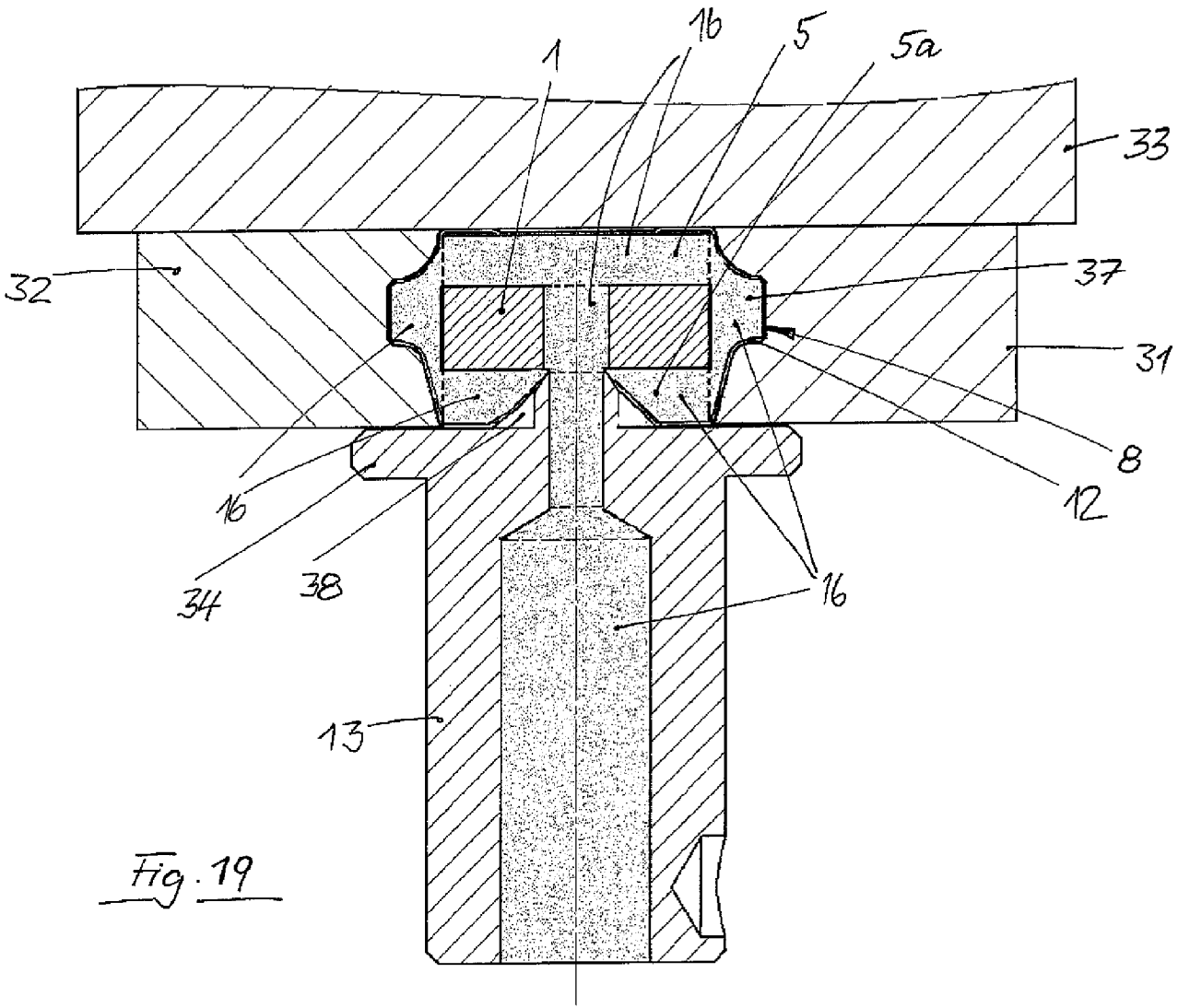
FIG. 19 shows the cross-section as in FIG. 18 after injecting sealing compound.

FIG. 17 shows that the recesses 5 and 5*a* of the linear connector 1 open into hollow spaces 37, which exist between the longitudinal sides 4 of the linear connector 1 and the flanks 12 of the hollow profile bar 8. FIG. 17 shows a cross-section of this, which is placed exactly in the seam 14, wherein in FIG. 17 the nozzle 13 has not pushed in the outside wall 10 yet. FIG. 18 shows the corresponding cross-section of FIG. 17, however after the outside wall 10 has been pressed in and before injecting sealing compound 16. FIG. 19 shows, in the same cross-section as in FIG. 18, how the sealing compound 16 completely spreads around the linear connector 1 in the region of the recesses 5 and 6*a* and not only fills in the waist, which is formed by the recesses 5, 5*a*, and 6, but also penetrates into the hollow spaces 37 between the linear connector 1 and the flanks 12 of the linear connector and flows, in these hollow spaces 37, even a small distance in the longitudinal direction of the hollow profile bar 8, which is shown in FIG. 15.

Figure 16:
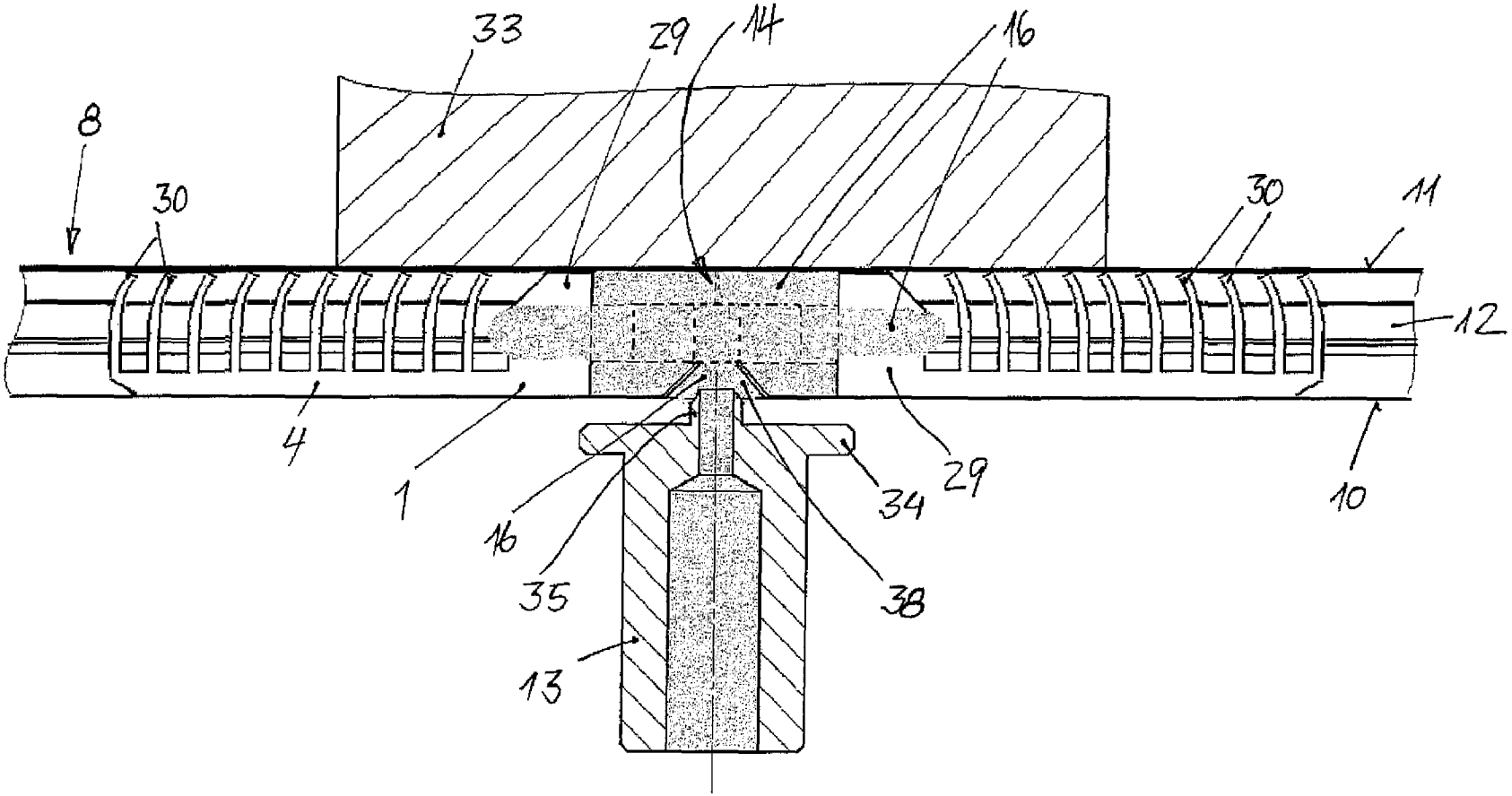
FIG. 16 shows the hollow profile bar in a section as in FIG. 15, wherein the nozzle, which is used to inject the sealing compound, is pulled back approximately to the alignment of the outside wall of the hollow profile bar.
Figure 20:
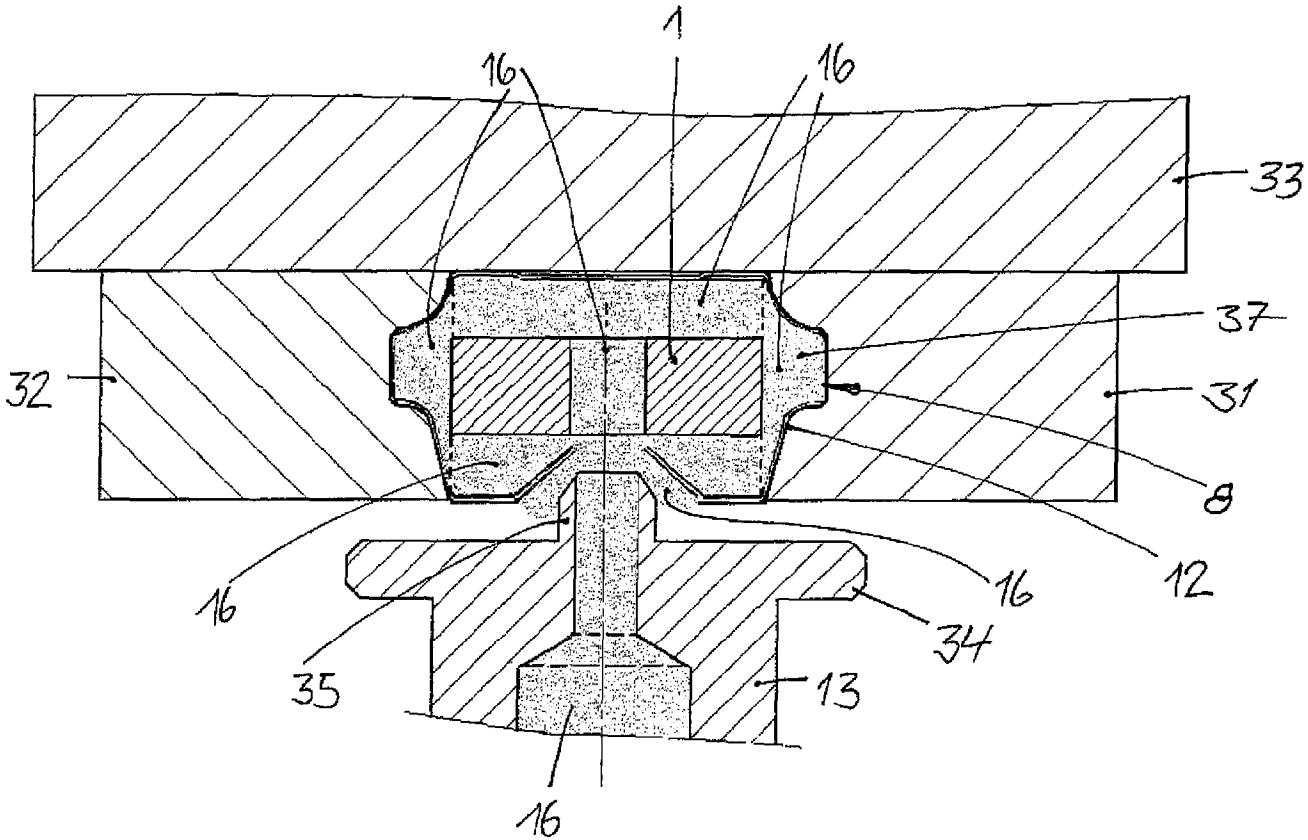
FIG. 20 shows a cross-section corresponding to FIG. 19 at a time at which the nozzle is pulled back a short distance.

The sealing compound 16 is intended to seal the entire seam 14 from the inside. This can be ensured by injecting a specified amount of sealing compound 16, which based on empirical values can be determined so that it suffices to seal the entire seam 14. Once this has been done, the nozzle 13 is pulled back a small distance and the depression 38 in the outside wall 10 formed by the outside wall 10 being pushed in is filled with the sealing compound 16, thereby completing the sealing of the seam 14, see FIG. 16 and FIG. 20.

After the nozzle 13 has been removed and the clamping jaws 31 opened, the hollow profile bar 8, which has already been closed to form a frame, can be processes further. It is now sealed and can be installed as a spacer in an insulating glass pane in the known manner. According to the invention, sealing compound is only required on the flanks 13 for the installation into a insulating glass pane. In this case, the seam 14 would be the only location through which water vapor could penetrate through the hollow profile bar 8 into the inner chamber of the insulating glass pane, however this seam 14 is perfectly sealed according to the invention. A desiccant, which is supposed to absorb moisture that may be present in the inner chamber of the insulating glass pane, may be embedded in the sealing compound 16 to be applied to the flanks 12, instead of being filled into the hollow profile bar 8, as is customary. This has the advantage that the inside wall 11 of the hollow profile bar 8 does not require any perforation, through which water vapor from the inner chamber of the insulating glass pane could reach the inner chamber of the hollow profile bar 8. The hollow profile bar 8, in this case, forms a double barrier to prevent water vapor from penetrating from the outside into the insulating glass pane.

Figure 21:
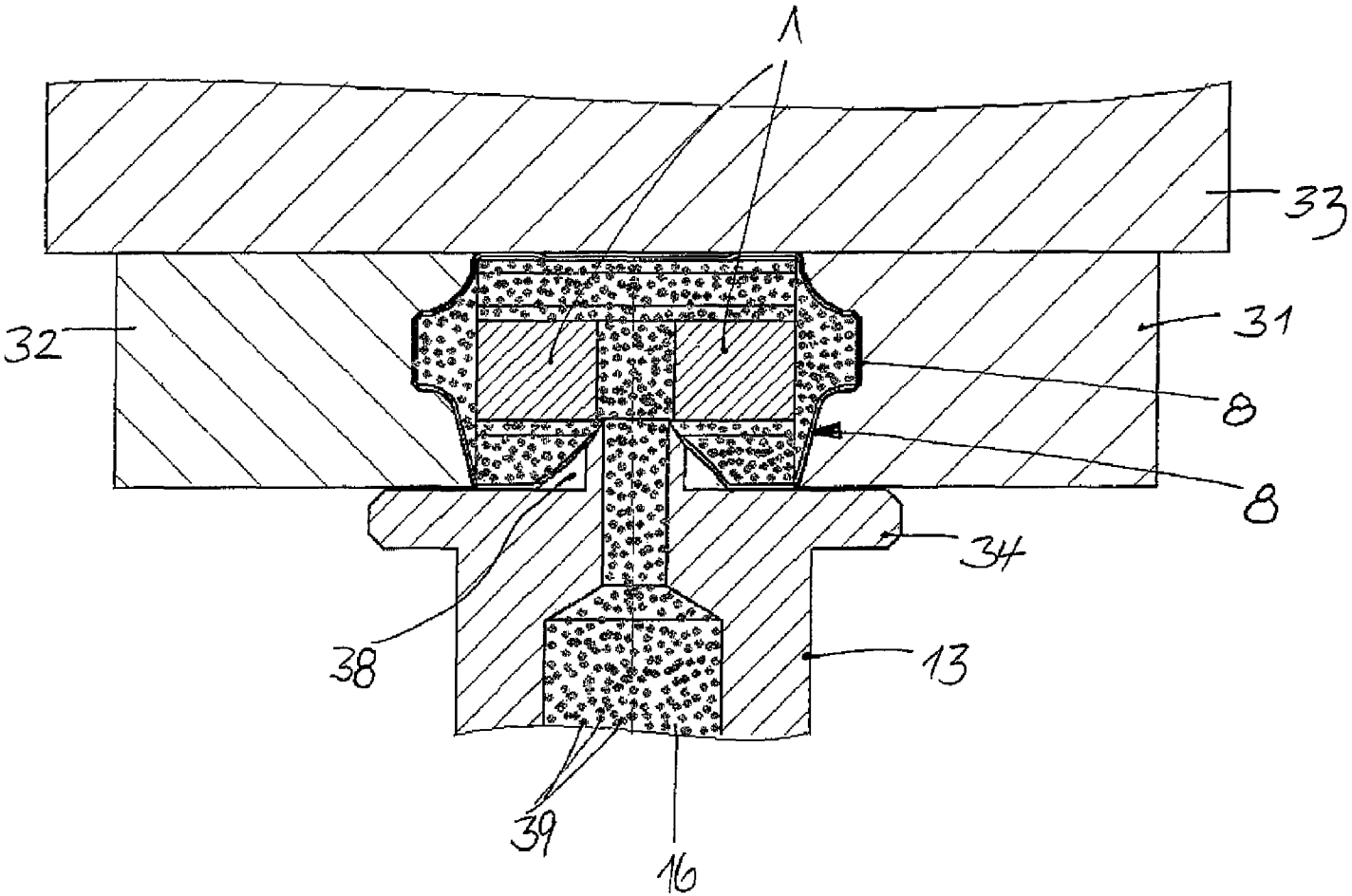
FIG. 21 shows a cross-section as in FIG. 19, however with a sealing compound containing a granular-desiccant.

A desiccant may also be embedded in the sealing compound 16 used to seal the seam 14 from the inside. This is schematically shown in FIG. 21, in which the granular desiccant—shown with exaggeration—is present in the sealing compound 16. Zeolite powder (molecular sieves) may be used as the desiccant.

The sealed insertion connection of two ends of a hollow profile bar 8 described based on FIGS. 10 to 21 can be employed similarly to the linear connection of two hollow profile bars 8.

LIST OF REFERENCE NUMERALS

1. Linear connector
2. Top side
3. Bottom side
4. Longitudinal sides, lateral surfaces
5, 5*a*. Flat recess, chute
6. Recess in 4
7. Hole, second holes
8. Hollow profile bar
9. Expansion
10. Outside wall
11. Inside wall
12. Flanks
13. Nozzle
14. Seam
15. Opening of the seam
16. Sealing compound
17. —
18. Strand-shaped semifinished product
19. Guide device
20. Drill
21. Drill
22. Severing tool/saw blade
23. Mounting
24. Axis
25. Stand
26. First holes
27. —
28. Tongs
29. Blocks
30. Fins
31. Clamping jaw
32. Clamping jaw
33. Abutment
34. Collar
35. Mouth
36. —
37. Hollow spaces
38. Depression
39. Desiccant

The invention claimed is:

1. A linear connector for connecting, two mutually opposed ends of a hollow profile bar so as to form a frame-shaped spacer for producing insulating glass panes, the linear connector comprising:

a top side;

a bottom side;

two lateral surfaces connecting the top side and the bottom side of the linear connector;

a waist disposed in a central region of the linear connector, the waist extending at least over an entire width of the top side or bottom side of the linear connector;

wherein the linear connector is produced from a solid material at least in the region of the waist, the waist extends completely around the linear connector and includes a hole extending through the linear connector from the top side to the bottom side; and two recesses extending from the top side to the bottom side and disposed next to each other on each of the two lateral surfaces of the linear connector in the region of the waist.

2. The linear connector according to claim 1, wherein the linear connector is produced entirely from solid material.

3. The linear connector according to claim 1, further comprising fins on either side of the waist, the fins extending over the entire width of the linear connector and are oriented toward the top side or bottom side of the linear connector.

4. The linear connector according to claim 1, wherein the hole is cylindrical or has a cylindrical section.

5. The linear connector according to claim 4, wherein the hole is expanded toward the bottom side of the linear connector.

6. The linear connector according to claim 4, wherein the hole is expanded conically, in a wedge shape or convexly toward the bottom side of the linear connector.

7. A linear connector according to claim 1 wherein the waist on the top side and/or on the bottom side of the linear connector is formed by a flat recess or chute extending from one lateral surface to the opposite lateral surface of the linear connector.

8. A linear connector according claim 1 wherein the waist at the two lateral surfaces is formed by at least one recess extending from the top side to the bottom side of the linear connector.

9. A linear connector according to claim 1 wherein the lateral surfaces outside of the waist have a planar design.

10. The linear connector according to claim 9, wherein the lateral surfaces are parallel to each other.

11. A linear connector according to claim 1 wherein the linear connector is formed of a plastic material.

12. The linear connector according to claim 1, wherein the recesses are delimited in a semi-cylindrical manner.

13. The linear connector according to claim 1 wherein the recesses provided on the lateral surfaces of the linear connector extend up to the two ends of the fiat recesses, which form the waist on the top side and on the bottom side of the linear connector.

14. The linear connector according to claim 1, wherein the waist at the two lateral surfaces is formed by at least one recess extending from the top side to the bottom side of the linear connector and being delimited by a part of a cylinder jacket having a cylinder axis running transversely to the top side of the linear connector.

15. The linear connector according to claim 14, wherein the part of the cylinder jacket area of the recess extends over a circumferential angle of no more than 180°.

* * * * *